US010501872B2

(12) United States Patent
Sampers et al.

(10) Patent No.: US 10,501,872 B2
(45) Date of Patent: Dec. 10, 2019

(54) DRIVE MECHANISM FOR DRIVING A HEALD FRAME OF A WEAVING MACHINE

(71) Applicant: PICANOL, Ypres (BE)

(72) Inventors: Dirk Sampers, Oostvleteren (BE); Chris Noppe, Ingelmunster (BE); Emmanuel Delboo, Ypres (BE); Sven Cafmeyer, Ypres (BE); Marc Adriaen, Hollebeke (BE)

(73) Assignee: Picanol, Ypres (BE)

( * ) Notice: Subject to any disclaimer, the term of this patent is extended or adjusted under 35 U.S.C. 154(b) by 80 days.

(21) Appl. No.: 15/754,225

(22) PCT Filed: Aug. 1, 2016

(86) PCT No.: PCT/EP2016/068303
§ 371 (c)(1),
(2) Date: Feb. 21, 2018

(87) PCT Pub. No.: WO2017/032556
PCT Pub. Date: Mar. 2, 2017

(65) Prior Publication Data

US 2018/0291537 A1 Oct. 11, 2018

(30) Foreign Application Priority Data

Aug. 26, 2015 (BE) ..... 2015/0210
Aug. 26, 2015 (BE) ..... 2015/0227

(51) Int. Cl.
*D03C 9/06* (2006.01)
*D03C 13/00* (2006.01)

(52) U.S. Cl.
CPC ..... *D03C 13/025* (2013.01); *D03C 9/0683* (2013.01); *D03C 2700/0127* (2013.01);
(Continued)

(58) Field of Classification Search
CPC . D03C 5/02; D03C 1/26; D03C 13/00; D03C 13/025; D03C 1/144; D03C 1/148;
(Continued)

(56) References Cited

U.S. PATENT DOCUMENTS 2,592,820 A * 4/1952 Moessinger ..... D03C 5/005 139/56
3,833,027 A * 9/1974 Pavlica ..... D03C 1/06 139/71

(Continued)

FOREIGN PATENT DOCUMENTS

CN 1127807 A 7/1996
CN 204000098 U 12/2014

(Continued)

OTHER PUBLICATIONS

International Search Report dated Oct. 28, 2016 in connection with PCT/EP2016/068303.

(Continued)

*Primary Examiner* — Robert H Muromoto, Jr.
(74) *Attorney, Agent, or Firm* — Akerman LLP

(57) ABSTRACT

A drive mechanism for driving a heald frame of a weaving machine, the drive mechanism having a crank rotating about a crank axis, a coupling rod, and a swivel lever having a first arm and a second arm, the coupling rod is linked to the first arm of the swivel lever by a second hinged joint adjustable with respect to the first arm of the swivel lever, wherein in at intended locations of the second hinged joint with respect to the first arm of the swivel lever, the second hinged joint is situated on an arc of an imaginary circle when the swivel lever is in a central position between the upper position and the lower position, wherein the imaginary circle has a radius that is equal to the distance between the first hinged joint and
(Continued)

the second hinged joint, and the imaginary circle has a center that coincides with the crank axis.

15 Claims, 11 Drawing Sheets

(52) U.S. Cl.
CPC ..... *D03C 2700/0133* (2013.01); *D03C 2700/0183* (2013.01)

(58) Field of Classification Search
CPC .... D03C 2700/0111; D03C 2700/0127; D03C 2700/0155; D03C 2700/14; D03C 5/005; D03C 9/0683; D03C 2700/0133; D03C 2700/0183; D03D 51/08; D03D 47/12; D03D 47/34; D03D 51/34
See application file for complete search history.

(56) References Cited

U.S. PATENT DOCUMENTS 3,884,273 A * 5/1975 Pavlica ..... D03C 1/26 139/71
3,991,793 A * 11/1976 Demuth ..... D03C 5/02 139/79
4,185,666 A * 1/1980 Heiniger ..... D03C 13/00 139/82
4,592,392 A * 6/1986 Vandeweghe ..... D03D 51/08 139/1 E
2018/0237962 A1* 8/2018 Sampers ..... D03C 13/025

FOREIGN PATENT DOCUMENTS

EP 1477598 A2 11/2004
EP 1486597 A2 12/2004
EP 1715090 A2 10/2006
JP H10130984 A 5/1998
JP 2013014867 A 1/2013

OTHER PUBLICATIONS

Written Opinion of the International Searching Authority issued in connection with PCT/EP2016/068303.
Belgian Search Report issued in connection with BE 2015/0210.
Office Action and Search Report dated May 17, 2019 issued in connection with corresponding Chinese Patent Application No. 201680049524.7.

* cited by examiner

DRIVE MECHANISM FOR DRIVING A HEALD FRAME OF A WEAVING MACHINE

This application is a national phase of PCT/EP2016/068303, filed Aug. 1, 2016, and claims priority to BE 2015/0227, filed Aug. 26, 2015 and BE 2015/0210, filed Aug. 26, 2015, the entire contents of which are hereby incorporated by reference.

TECHNICAL FIELD AND PRIOR ART

The invention relates to a drive mechanism for driving a heald frame of a weaving machine. The invention further relates to a shed-forming device with a number of heald frames and an equal number of drive mechanisms, wherein the stroke of the heald frames is adjustable, and to a method for adjusting a stroke of a heald frame of a weaving machine.

More in particular, the invention relates to a drive mechanism, to a shed-forming device comprising a drive mechanism and to a method for adjusting the stroke of a heald frame by a drive mechanism, wherein the drive mechanism comprises a crank rotating about a crank axis, a coupling rod, and a swivel lever having a first arm and a second arm, wherein the swivel lever is swivelable to-and-fro about a swivel axis between an upper position and a lower position, wherein the coupling rod is linked to the crank by a first hinged joint, which first hinged joint is eccentric to the crank axis, and the coupling rod is linked to the first arm of the swivel lever by a second hinged joint. The crank, the coupling rod and the swivel lever form a four-link system, also referred to as quadric link.

EP 1 486 597 A2 and EP 1 715 090 A2 disclose shed-forming devices having a plurality of quadric links for converting rotational movements of a plurality of drive shafts into a reciprocal movement of heald frames.

In order to adjust the stroke of the heald frame, a location of the second hinged joint between the coupling rod and the first arm of the swivel lever is adjusted. The movement of the heald frame needs to be synchronized with the main shaft of the weaving machine. For this purpose, EP 1 715 090 A2 discloses a control apparatus, wherein a sensor device comprising a proximity sensor arranged stationary at the weaving machine and a detected portion attached to the swivel lever is provided for detecting the presence of a swivel lever in the area of one of the upper or the lower position. The duration of the signal generated is evaluated in order to determine the turning point of the movement of the swivel lever at the midpoint of the signal.

SUMMARY OF THE INVENTION

It is an object of the present invention to provide a drive mechanism and a shed-forming device comprising a drive mechanism, wherein a stroke of a heald frame can be easily adjusted. It is a further object of the present invention to provide a method for adjusting a stroke of a heald frame.

These objects are solved by a drive mechanism with the features of claim 1, by a shed-forming device with the features of claim 6, by a method with the features of claim 10, and by the dependent claims.

According to a first aspect of the invention, a drive mechanism for driving a heald frame of a weaving machine is provided, the drive mechanism comprising a crank rotating about a crank axis, a coupling rod, and a swivel lever having a first arm and a second arm, wherein the swivel lever is swivelable to-and-fro about a swivel axis between an upper position and a lower position, wherein the coupling rod is linked to the crank by a first hinged joint, which first hinged joint is eccentric to the crank axis, and the coupling rod is linked to the first arm of the swivel lever by a second hinged joint, wherein a location of the second hinged joint is adjustable with respect to the first arm of the swivel lever, and wherein in all intended locations of the second hinged joint with respect to the first arm of the swivel lever, the second hinged joint is situated on an arc of an imaginary circle when a swivel lever is in the central position between the upper position and the lower position, wherein the imaginary circle has a radius that is equal to the distance between the first hinged joint and the second hinged joint, and the imaginary circle has a center that coincides with the crank axis.

In the context of the application, the central position of the swivel lever is defined as the position that corresponds at least approximately to the closed shed position of a heald frame linked to the swivel lever, in other words a position that is located halfway or approximately halfway between the upper position and the lower position of the swivel lever. The location of the second hinged joint is adjustable for adjusting a stroke of a heald frame attached to the second arm of the swivel lever. The closer the second hinged joint is located to the swivel axis, the larger is the stroke of the heald frame. Except upon adjusting the location of the second hinged joint, the location of the second hinged joint is fixed with respect to the swivel lever. Hence, the possible or intended locations of the second hinged joint can also be determined in relation to the swivel lever. According to the invention, the intended locations are chosen so that all intended locations of the second hinged joint are situated on an arc of an imaginary circle when the swivel lever is in the central position between the upper position and the lower position, wherein said imaginary circle is fixed in position. According to the invention, the center of the imaginary circle coincides with the crank axis. In other words, all intended or possible locations of the second hinged joint are situated on an arc of an imaginary circle, which imaginary circle has a center that coincides with the crank axis and has a radius that is equal to the distance between the first hinged joint and the second hinged joint.

In result of this geometrical relationship, when adjusting the location of the second hinged joint at the swivel lever in order to adjust a stroke of the heald frame, the central position of the swivel lever remains constant at least within acceptable tolerances. The heald frame is attached to the second arm of the swivel lever by means of an attaching arrangement. As the central position of the swivel lever remains constant within acceptable tolerances, also the central position of the heald frame remains constant within acceptable tolerances. Consequently, the attaching arrangement of the heald frame at the weaving machine does not need to be adjusted when adjusting the stroke of the heald frame.

The adjustment of the stroke may be carried out in any position of the swivel lever, and the adjustment does not necessarily have to be carried out while the swivel lever is in the central position.

In one embodiment, the first arm of the swivel lever is provided with a plurality of through holes situated on the arc of the imaginary circle when the swivel lever is in the central position, wherein the coupling rod can be mounted to the first arm by means of an axle received in a through hole. In this case, the axle functions as pivot axis of the second hinged joint.

In preferred embodiments, the first arm of the swivel lever is curved and the location of the second hinged joint is adjustable, preferably steplessly adjustable, along the first arm, wherein a curvature of the first arm is chosen so that upon adjusting the location of the second hinged joint along the first arm, the second hinged joint remains situated on the arc of the imaginary circle, when the swivel lever is in the central position.

In preferred embodiments, the coupling rod is mounted to the first arm by means of a mounting element, wherein the mounting element is slidably mounted to the first arm and fixable in a mounting position at the first arm, and wherein the coupling rod is mounted to the mounting element by the second hinged joint. The mounting element allows for a stepless adjustment of the location of the second hinged joint, and, hence, provides a high flexibility. The location of the second hinged joint with respect to the swivel lever depends on the shape of the mounting element. Therefore, the shape and/or the geometry of the mounting element is preferably considered when designing the curvature of the first arm of the swivel lever so that upon adjusting the location along the first arm the second hinged joint remains situated on the arc of the imaginary circle.

As mentioned, the heald frame is attached to the second arm of the swivel lever. When the swivel lever is in its central position between the upper position and the lower position, the second arm extends at a defined angle. In order to allow for a simple geometry, in preferred embodiments, the second arm extends horizontally when the swivel lever is arranged in the central position between the upper position and the lower position.

In preferred embodiments, a sensor device is provided for detecting a state at which the swivel lever reaches the central position between the upper position and the lower position. The information thus obtained can be used in a processing device of the drive mechanism and/or of the weaving machine in order to synchronize the movement of the heald frame with a main shaft of the weaving machine. The main shaft of the weaving machine is, for example, a virtual shaft that rotates in accordance with the weaving cycle, wherein the main shaft is at an angle of zero degrees each time at beat-up of a weft thread and rotates over one revolution between two beat-ups.

The swivel lever is moved to-and-fro between its upper position and its lower position, wherein the swivel lever reaches the central position twice per revolution of the crank, this means in two orientations of the crank. In order to distinguish the two orientations, in preferred embodiments, the sensor device is adapted to determine a direction of the rotation of the swivel lever. In one embodiment, the sensor device comprises at least three members comprising both a target set with one or more targets and a detector set with one or more detectors, wherein one of the detector set and the target set is arranged at the swivel lever and the other one is arranged stationary on the weaving machine, wherein targets of the target set and/or detectors of the detector set have different properties for generating a first signal when approaching the central position from the upper position or when departing from the central position towards the upper position and for generating a second signal when approaching the central position from the lower position or when departing from the central position towards the lower position, wherein the second signal differs from the first signal. In other words, the sensor device in one embodiment comprises a target set with a first target and a second target having different properties, which are detectable when moving the swivel lever into the central position upon an upward movement or a downward movement, respectively. In an alternative embodiment, the sensor device comprises a detector set with a first detector and a second detector having different properties. In both cases, due to the different properties different signals are generated when rotating the swivel lever clockwise or counterclockwise.

According to a second aspect of the invention, a shed-forming device with a number of heald frames and an equal number of drive mechanisms is provided, wherein each drive mechanism comprises a crank, a coupling rod and a swivel lever, and wherein one drive mechanism is assigned to each heald frame. In other words, each heald frame is driven by one drive mechanism.

Preferably, each crank is driven by an individual drive motor. This allows for a high flexibility during weaving.

The drive mechanisms preferably have a common swivel axis. However, according to preferred embodiments, the crank axes of the drive mechanisms are arranged in parallel in their length direction, but offset from each other in the axial direction and/or perpendicular to the axial direction. When the crank axes are offset form each other perpendicular to the axial direction, the distances between the crank axis and the swivel axis differ for different drive mechanisms. This results in different lengths of the coupling rods and also in different designs of the first arm of the swivel lever in order to ensure the geometrical constraints.

In order to minimize the number of different components, in one embodiment, the shed-forming device comprises at least one pair of drive mechanisms having axially aligned crank axes.

According to a third aspect of the invention, a method for adjusting a stroke of a heald frame of a weaving machine is provided, wherein the heald frame is driven by a drive mechanism comprising a crank rotating about a crank axis, a coupling rod, and a swivel lever having a first arm and a second arm, wherein the swivel lever is swivelable to-and-fro about a swivel axis between an upper position and a lower position, and wherein the coupling rod is linked to the crank by a first hinged joint, which first hinged joint is eccentric to the crank axis, and the coupling rod is linked to the first arm of the swivel lever by a second hinged joint, the method comprising adjusting a location of the second hinged joint with respect to the first arm of the swivel lever, wherein the location of the second hinged joint is adjusted in such way that the second hinged joint remains situated on an arc of an imaginary circle when the swivel lever is in a central position between the upper position and the lower position, wherein the imaginary circle has a radius that is equal to the distance between the first hinged joint and the second hinged joint, and the imaginary circle has a center that coincides with the crank axis.

As the second hinged joint remains situated on the arc of the imaginary circle, the central position of the swivel lever and, hence, the central position of the heald frame attached thereto, remains constant within acceptable tolerances when adjusting the stroke of the heald frame. During the adjustment, the second hinged joint may temporarily be situated displaced from the arc of the imaginary circle as long as, after the adjustment is accomplished, the second hinged joint is situated on the arc of the imaginary circle when the swivel lever is in the central position.

In preferred embodiments, the first arm of the swivel lever is curved and the location of the second hinged joint is adjusted along the first arm, wherein a curvature of the first arm is chosen so that upon adjusting the location of the second hinged joint along the first arm the second hinged joint is moved along the arc of the imaginary circle.

As mentioned, the adjustment of the stroke may be carried out in any position of the swivel lever. In one embodiment, the swivel lever is held in position during an adjustment of the location of the second hinged joint and the crank is moved together with the coupling rod to allow for a relative movement with respect to the swivel lever. In case the swivel lever is held in the central position, the position of the crank immediately after the adjustment can be captured for subsequent use in a processing device.

In preferred embodiments, during an adjustment of the location of the second hinged joint, the crank is held in position and the swivel lever is moved with respect to the crank. After the adjustment, the orientation of the crank fixed during the adjustment, no longer is the orientation of the crank in a state of the drive mechanism, in which the swivel lever is in its central position. Thus, a synchronization of the movement of the heald frame driven by the drive mechanism with a main shaft of the weaving machine is no longer given. Therefore, after an adjustment of the location of the second hinged joint, a processing device of the drive mechanism is arranged in order to synchronize the movement of the heald frame with the main shaft of a weaving machine. For this purpose, in preferred embodiments after the adjustment of the location of the second hinged joint while holding the crank fixed in position, the crank is driven to move the swivel lever into a measuring position, in particular into the central position between the upper position and the lower position.

In preferred embodiments, a state, when the swivel lever reaches the measuring position, in particular the central position between the upper position and the lower position is detected. When the state is detected, when the swivel lever reaches the central position between the upper position and the lower position or another suitable measuring position, this information can be provided to a processing device of the drive mechanism and/or of the weaving machine for a synchronization of the movement of the heald frame with a main shaft of the weaving machine.

As mentioned, the central position of the swivel lever is reached twice per revolution of the crank. In order to distinguish the two states, in preferred embodiments a first signal is generated by the sensor device when the swivel lever approaches the central position from the upper position or when the swivel lever departs from the central position towards the upper position and a second signal is generated by the sensor device when the swivel lever approaches the central position from the lower position or when the swivel lever departs from the central position towards the lower position, wherein the second signal differs from the first signal.

In preferred embodiments, when the swivel lever is in the central position between the upper position and the lower position, an angular position or orientation of the crank of the drive mechanism and/or an encoder count value of the drive motor driving the crank of the drive mechanism is captured for determining a reference orientation of the crank. As the central position is reached twice per revolution of the crank, two reference orientations of the crank can be determined.

BRIEF DESCRIPTION OF THE DRAWINGS

Further characteristics and advantages of the invention will emerge from the following description of the embodiments schematically illustrated in the drawings. Throughout the drawings, the same elements will be indicated by the same reference numerals. In the drawings.

DETAILED DESCRIPTION OF EMBODIMENTS

Figure 1:
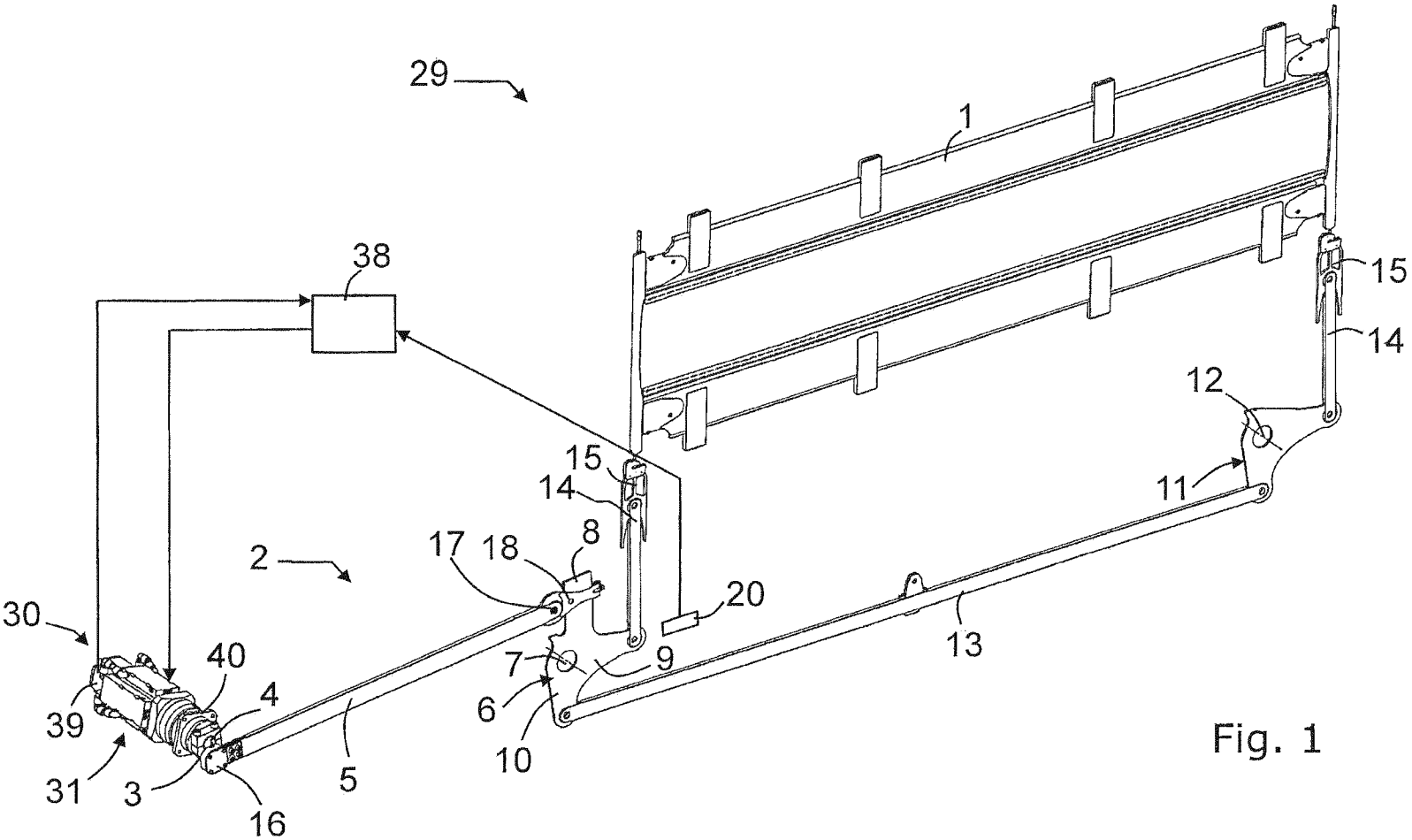
FIG. 1 shows a heald frame and a drive mechanism of a shed-forming device in a perspective view.
Figure 2:
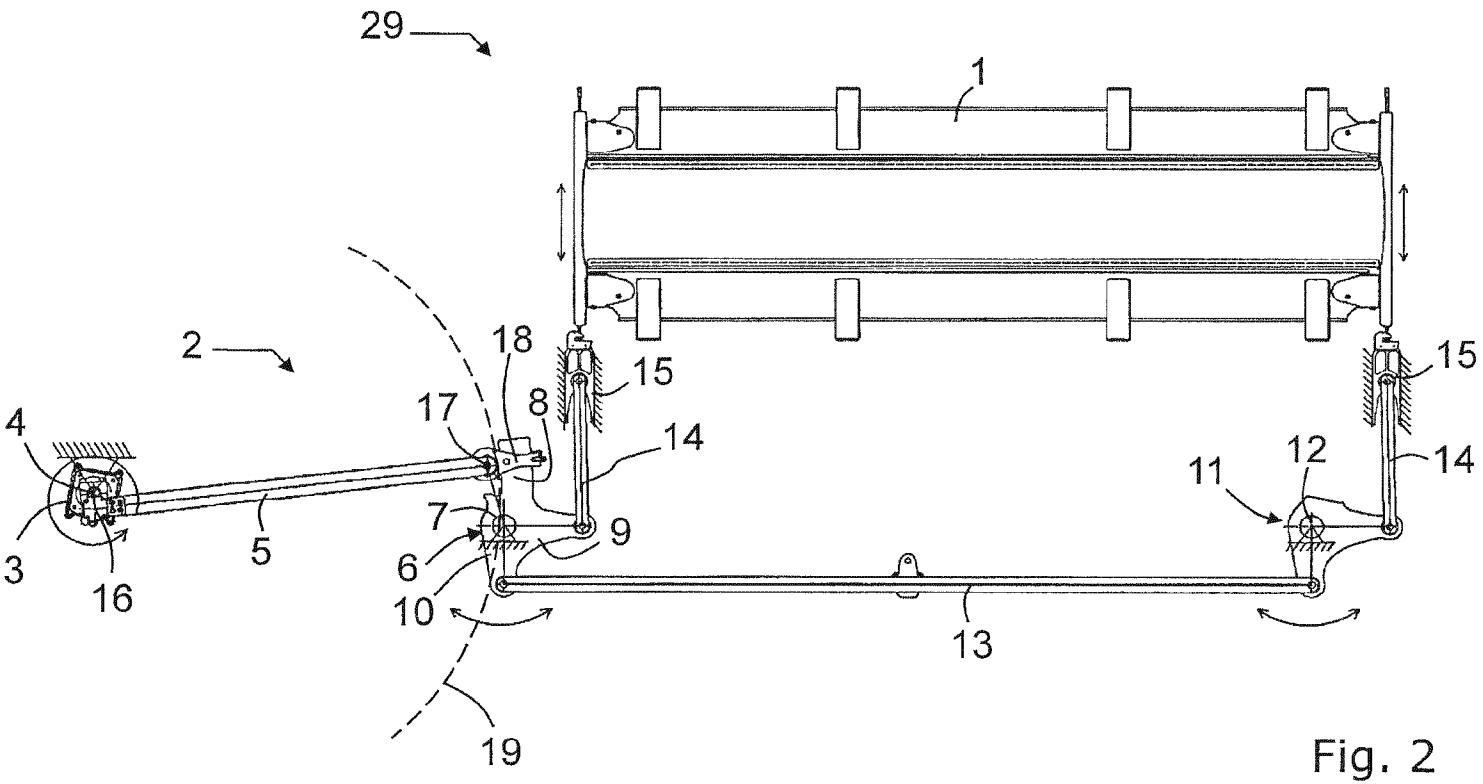
FIG. 2 shows schematically a front view of the heald frame and a part of the drive mechanism of FIG. 1.

FIGS. 1 and 2 show a heald frame 1 and a drive mechanism 2 of a shed-forming device 29. The shed-forming device 29 comprises a number of heald frames 1 and an equal number of drive mechanisms 2, wherein one drive mechanism 2 is assigned to each heald frame 1 and is driven by a drive system 30.

The drive mechanism 2 for driving the heald frame 1 comprises a crank 3 rotating about a crank axis 4, a coupling rod 5, and a swivel lever 6. The swivel lever 6 is swivelable to-and-fro about a swivel axis 7 between an upper position and a lower position. The swivel lever 6 has a first arm 8, a second arm 9 and a third arm 10. The drive mechanism 2 further comprises a second swivel lever 11, that is swivelable to-and-fro about a second swivel axis 12 between an upper position and a lower position. The second swivel lever 11 is linked to the third arm 10 of the swivel lever 6 by means of a connecting rod 13 and driven by the swivel lever 6 to conjointly move with the swivel lever 6.

The heald frame 1 is linked to the second arm 9 of the swivel lever 6 by means of a lifting rod 14 and a fixation element 15 that is guided in the weaving machine. The second swivel lever 11 is also linked via a lifting rod 14 and a fixation element 15 to the heald frame 1.

The coupling rod 5 of the drive mechanism 2 is linked to the crank 3 by a first hinged joint 16, which first hinged joint 16 is eccentric to the crank axis 4. Further, the coupling rod 5 is linked to the first arm 8 of the swivel lever 6 by a second hinged joint 17.

In the embodiment shown, a mounting element 18 is provided and the coupling rod 5 is mounted to the first arm 8 by means of a mounting element 18. The mounting element 18 is slidably mounted to the first arm 8 and fixable in a mounting position at the first arm 8. The coupling rod 5 is pivotally mounted to the mounting element 18 by the second hinged joint 17. For adjusting a stroke of the heald frame 1, a location of the second hinged joint 17 is adjustable with respect to the first arm 8 of the swivel lever 6 by moving the mounting element 18 along the first arm 8. The closer the mounting element 18 and, hence, the location of the second hinged joint 17 is moved towards the swivel axis 7, the larger the stroke of the heald frame 1. The farther the mounting element 18 and, hence, the location of the second hinged joint 17 is moved away from the swivel axis 7, the smaller the stroke of the heald frame 1.

In the embodiment shown, the first arm 8 of the swivel lever 6 is curved and the location of the second hinged joint 17 is adjustable along the first arm 8 by sliding the mounting element 18 along the first arm 8. A curvature of the first arm 8 is chosen so that upon adjusting the location of the second hinged joint 17 along the first arm 8, the second hinged joint 17 remains situated on an arc of an imaginary circle 19 when the swivel lever 6 is in the central position, which imaginary circle 19 will be explained with reference to FIG. 3. This is advantageous when used in a method for adjusting the stroke of a heald frame 1.

Figure 3:
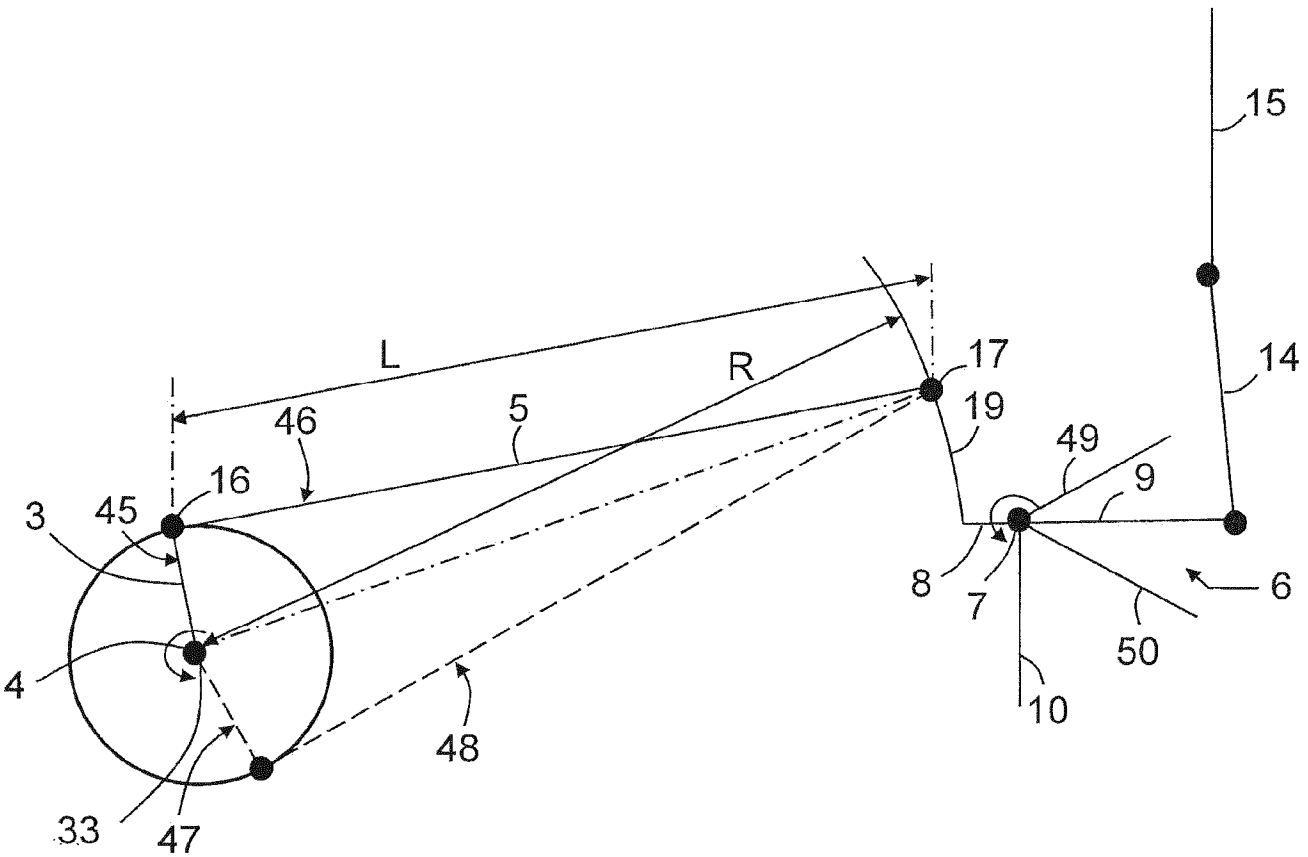
FIG. 3 shows a schematic diagram of a drive mechanism for a location of the second hinged joint.
Figure 4:
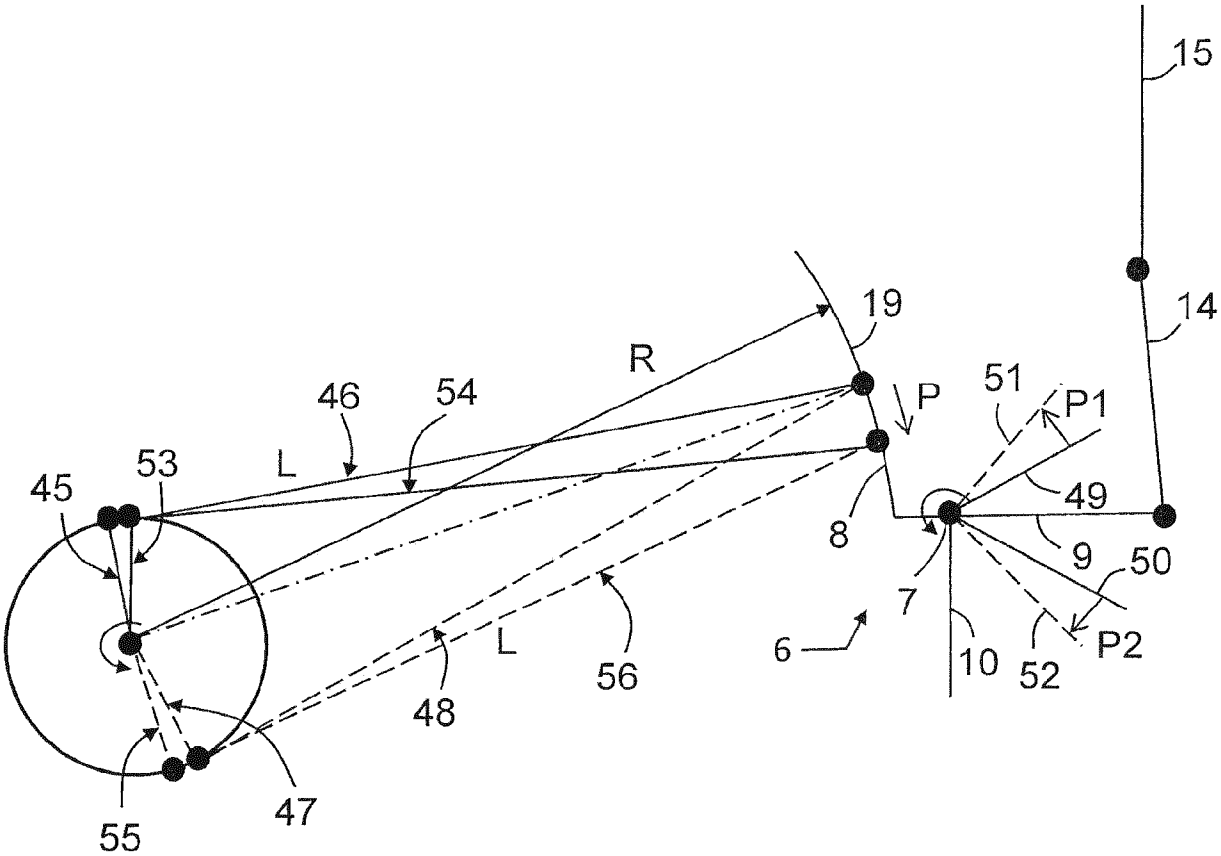
FIG. 4 shows a schematic diagram of FIG. 3 for two different locations of the second hinged joint.

FIG. 3 is a schematic diagram of the drive mechanism 2 of FIG. 1, wherein the swivel lever 6 is in the central position between the upper position and the lower position. The schematically shown swivel lever 6 is driven by the crank 3 to-and-fro between the upper position and the lower position, wherein the central position is reached twice per revolution of the crank 3. In FIG. 3 a first state of the drive mechanism 2 with crank 3 and coupling rod 5 is indicated with solid lines 45, 46. A second state of the drive mechanism 2 with crank 3 and coupling rod 5 is indicated with broken lines 47, 48. The orientation of the second arm 9 of the swivel lever 6 when the swivel lever 6 is in the upper position is indicated with a solid line 49, and the orientation of the second arm 9 of the swivel lever 6 when the swivel lever 6 is in the lower position is indicated with a solid line 50. As shown in FIG. 3, a curvature of the first arm 8 of the swivel lever 6 is chosen so that when moving the second hinged joint 17 along the first arm 8, the second hinged joint 17 moves along an arc of the imaginary circle 19, wherein the imaginary circle 19 has a radius R that is equal to the distance L between the first hinged joint 16 and the second hinged joint 17, and the imaginary circle 19 has a center 33 that coincides with the crank axis 4 when the swivel lever 6, as shown in FIG. 3, is in the central position between the upper position and the lower position. This allows that in all intended locations of the second hinged joint 17 with respect to the first arm 8 of the swivel lever 6, the second hinged joint 17 is situated on an arc of this imaginary circle 19. When moving the second hinged joint 17 along the arc of the imaginary circle 19 in the direction of the arrow P, as indicated in FIG. 4, the central position of the swivel lever 6 remains the same within acceptable tolerances. The upper position and the lower position are changed in the direction of the corresponding arrows P1, P2 shown in FIG. 4 and the resulting upper position and lower position are illustrated by broken lines 51, 52. The moving of the second hinged joint 17 together with the mounting element 18 in the direction of the arrow P is limited by a stop 61 (shown in FIG. 5).

When changing the location of the second hinged joint 17 with respect to the swivel lever 6, the orientation or the relative angle of the crank 3 in a state at which the swivel lever 6 of the drive mechanism 2 is in its central position is also changed. Hence, after adjusting the location of the second hinged joint 17, a processing device 38 for the drive mechanism 2 needs to be calibrated again for a synchronization of the movement of the heald frame 1 with a main shaft of the weaving machine.

In an alternative embodiment, during an adjustment of the location of the second hinged joint 17 for changing the stroke of the heald frame 1, the crank 3 is held in position and the coupling rod 5 is moved with respect to the swivel lever 6 and the crank 3. Hence, the swivel lever 6 is moved out of its central position.

For a synchronization with the main shaft of the weaving machine, after adjusting of the location of the second hinged joint 17, the crank 3 in preferred embodiments is driven to move the swivel lever 6 into a measuring position 26 (indicated in FIG. 6), wherein the orientation of the crank 3 at which the swivel lever 6 reaches the measuring position is captured. The crank 3 is driven for example by means of a drive motor 31 (shown in FIG. 1) using an incremental encoder 39, wherein for a synchronization or calibration at the orientation of the crank 3 at which the swivel lever 6 reaches the measuring position, an encoder counter value of the drive motor 31 can be captured and a reference orientation of the crank 3 is determined. In other words, the crank 3 is driven to move the swivel lever 6 into a measuring position 26 for a synchronization with a main shaft of the weaving machine. This allows to determine two states for the crank 3 and the coupling rod 5, a first state as indicated with solid lines 53 and 54 and a second state as indicated with broken lines 55 and 56, at which the swivel arm 6 reaches the central position. Hereby the solid lines 45 and 53 form a small angle with each other, and also the broken lines 47 and 55 form a small angle with each other. This means that the orientation of the crank 3 as indicated with lines 53 to 56, and the associated angular position of the main shaft of the weaving machine, can be determined at the measuring position. Based on the geometry of the drive mechanism 2 also the angular position of the main shaft of the weaving machine can be determined at the upper position and the lower position of the heald frame, in other words the angular positions of the main shaft of the weaving machine that are associated to the positions of the crank 3, wherein the crank 3 and the coupling rod 5 are in prolongation of each other.

In preferred embodiments, the measuring position is the central position of the swivel lever 6 between the upper position and the lower position. Using the central position is advantageous as in the area of the central position the swivel lever 6 is moved with a higher speed than at the extreme positions, this means compared to the extreme positions the swivel lever 6 is moved over a larger angular range for a given angular difference of the drive motor 31. This allows determining an encoder counter value of the drive motor 31 very accurately at a state when the measuring position is reached. As discussed above, with an appropriate geometry, the central position remains almost constant when changing the stroke. Hence, a sensor device 20 can be positioned stationary and there is no need to adjust the position of the sensor device 20 after changing the stroke.

In one embodiment, a gear box 40 is arranged between the drive motor 31 and the crank 3. The gear box 40 has a transmission ratio of seven, this means the drive motor 31 makes seven revolutions per revolution of the crank 3, and the precision for determining an orientation of the crank 3 is seven times the precision for determining an angular difference of the drive motor 31 that is determined by the incremental encoder 39.

Each measuring position between the upper position and the lower position of the swivel lever 6 is reached twice per revolution of the crank 3. Therefore, preferably provision is made to distinguish the two states when the measuring position is reached, this means two orientations of the crank 3.

Figure 5:
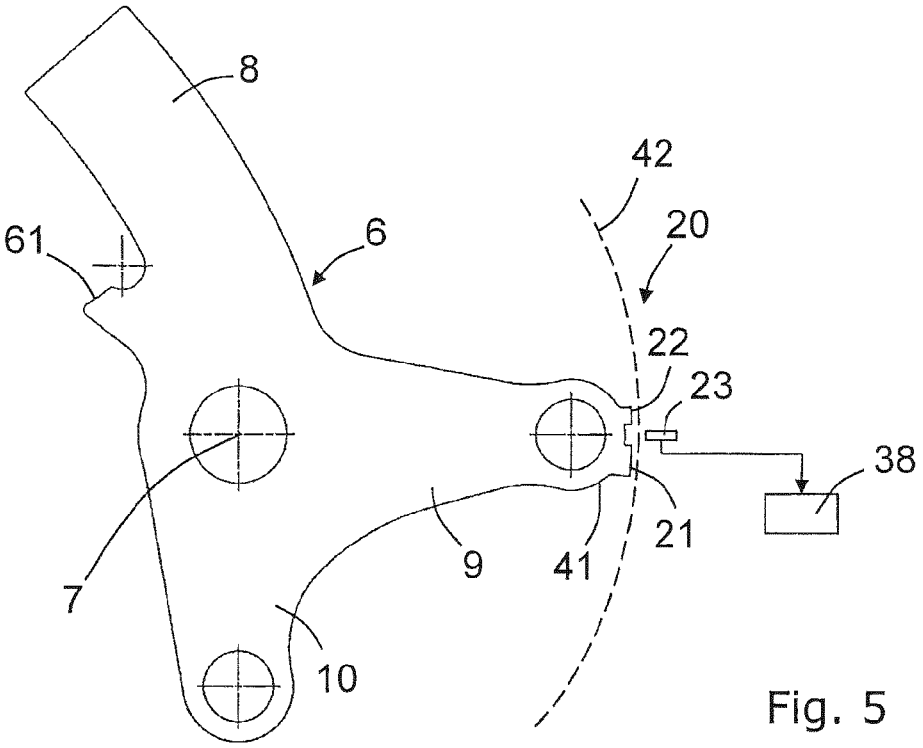
FIG. 5 shows a swivel lever of the drive mechanism of FIG. 1.

FIG. 5 shows a swivel lever 6 and a sensor device 20 for detecting a state at which the swivel lever 6 reaches a measuring position, in particular for detecting a state at which the swivel lever 6 reaches the measuring position between the upper position and the lower position. Preferably the measuring position is the position between the upper position and the lower position. In the embodiment shown, the second arm 9 of the swivel lever 6 extends horizontally, in other words in a horizontal direction when the swivel lever 6 is in the central position or the measuring position, shown in FIG. 5. The sensor device 20 is adapted for generating a first signal 24 and a second signal 25, shown in FIG. 6, and for detecting the presence of the swivel lever 6 in a measuring position. Further, the processing device 38 is provided for determining a state, at which the swivel lever 6 reaches the measuring position and/or for determining a stroke of the heald frame 1 using the first signal 24 and the second signal 25. In this way, the sensor device 20 can be used in a method for generating the first signal 24 and for generating the second signal 25.

The sensor device 20 comprises at least three members. In the embodiment of FIG. 5, the three members comprise both a target set with one or more targets 21, 22 and a detector set with one or more detectors 23, wherein one of the detector set and the target set is arranged on the swivel lever 6 and the other one is arranged stationary on the weaving machine, wherein targets 21, 22 of the target set and/or detectors 23 of the detector set have different properties for generating a first signal 24 when approaching the central position from the upper position or when departing from the central position towards the upper position and for generating a second signal 25 when approaching the central position from the lower position or when departing from the central position towards the lower position, wherein the second signal 25 differs from the first signal 24. Two of the members of the sensor device 20 are targets 21, 22 of a target set arranged on the swivel lever 6. The targets 21, 22 are also referred to as first target 21 and second target 22. The third member of the sensor device 20 is a detector 23 of a detector set. The sensor device 20 is adapted for detecting the presence of the swivel lever 6 of the drive mechanism 2 in a measuring position.

The first target 21 and the second target 22 have different properties for generating a first signal 24 when approaching the measuring position from the upper position or when departing from the measuring position towards the upper position and for generating a second signal 25 when approaching the measuring position from the lower position or when departing from the measuring position towards the lower position, wherein the second signal 25 differs from the first signal 24.

In the embodiment shown, the first target 21 and the second target 22 are protrusions that differ in size, in particular in length along the movement path 42 of the targets 21, 22 with respect to the detector 23, which protrusions are provided on the edge 41 of the second arm 9 of the swivel lever 6 for generating binary signals that are different from each other, in particular the first signal 24 and the second signal 25 are both binary signals, wherein the first signal 24 and the second signal 25 differ in properties. The detector 23 is arranged stationary on the weaving machine. In the embodiment shown, in a state of the drive mechanism 2 at which the swivel lever 6 is arranged in the measuring position shown in FIG. 3, the detector 23 is arranged at least approximately halfway between the first target 21 and the second target 22, wherein none of the targets 21, 22 is within the range of the detector 23.

Figure 6:
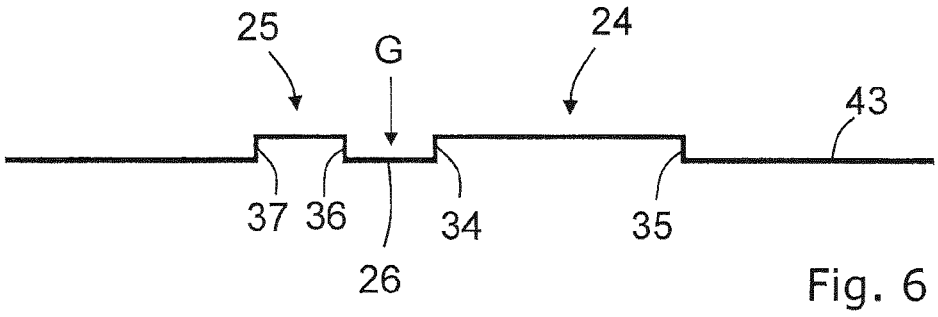
FIG. 6 shows a signal course of a sensor device for a movement of a heald frame.

FIG. 6 schematically shows a signal course 43 of the detector 23. When moving one of the targets 21, 22 within the range of the detector 23 along a movement path 42 determined as a circle having a center that coincides with the swivel axis 7, a high level is generated at the detector 23, whereas when none of the targets 21, 22 is within the range of the detector 23, a low level is generated at the detector 23. Due to the different length of the first target 21 and the second target 22 along the movement path 42, a first signal 24 generated when moving the first target 21 within the range of the detector 23, which is shown on the right in FIG. 6, differs in properties, in particular in duration from a second signal 25 generated when moving the second target 22 within the range of the detector 23, which is shown on the left in FIG. 6. The duration can be determined as an encoder count value of the encoder 39 of the drive motor 31. According to an alternative embodiment the duration can also be determined as an angular difference of a main shaft of the weaving machine.

As shown in FIG. 6, the first signal 24 has a first edge 34 and a second edge 35, whereas the second signal 25 has a first edge 36 and a second edge 37. The first signal 24 and the second signal 25 both comprise a rising edge and a subsequent falling edge generated when approaching the measuring position as well as when departing from the measuring position. The measuring position 26 can be determined as the position halfway between a falling edge and a subsequent rising edge generated when moving the swivel lever 6 past the measuring position 26 as indicated by an arrow G in FIG. 6, more in particular a position halfway between the inner edges 34 and 36. In other words, when moving past the measuring position, the position halfway between the first signal 24 and the second signal 25 is determined as the measuring position 26. In an alternative embodiment suitable use can be made of the edges 34, 35, 36 and/or 37 for determining the measuring position 26.

Depending on the direction of rotation of the swivel lever 6, the first target 21 or the second target 22 is moved first within the range of the detector 23 when moving the second arm 9 of the swivel lever 6 with the target set past the detector 23. Hence, depending on the direction of rotation of the swivel lever 6 the first signal 24 is generated before the second signal 25 or the first signal 24 is generated after the second signal 25. With the information about the arrangement of the first target 21 and the second target 22 on the swivel lever 6, the sensor device 20 allows for a determination of a direction of rotation of the swivel lever 6 from the signal course 43, as shown in FIG. 6.

In addition, the signal course 43 of the sensor device 20 may also be used for determining a stroke of a heald frame with sufficient accuracy. In an embodiment, the stroke of the heald frame 1 is determined using the first signal 24 and the second signal 25.

For determining the stroke, the angular position or orientation of the crank 3 and/or an encoder counter value of the drive motor 31 driving the crank 3 when reaching each of a measuring position 26, an outer edge 35 of the first signal 24, this means the edge of the first signal 24 that is further away from the determined measuring position 26, and an outer edge 37 of the second signal 25, this means the edge of the second signal 25 that is farther away from the determined measuring position 26, are determined, and the angular difference and/or the difference in encoder count values for moving from the measuring position 26 to the outer edge 35 of the first signal 24 and from the measuring position 26 to the outer edge 37 of the second signal 25 is calculated. The difference in actual size, in particular the difference in actual length of the first target 21 and the second target 22 is known. Hence, using the determined angular difference and/or the calculated difference in encoder count values, the above known difference in the actual sizes as well as known geometrical lengths and angles of the drive mechanism 2, the stroke can be determined. As alternative, the stroke can be determined from the angular difference and/or the calculated difference in encoder count values based on a movement between both outer edges 35 and 37 and/or based on a movement between both inner edges 34 and 36.

Figure 7:
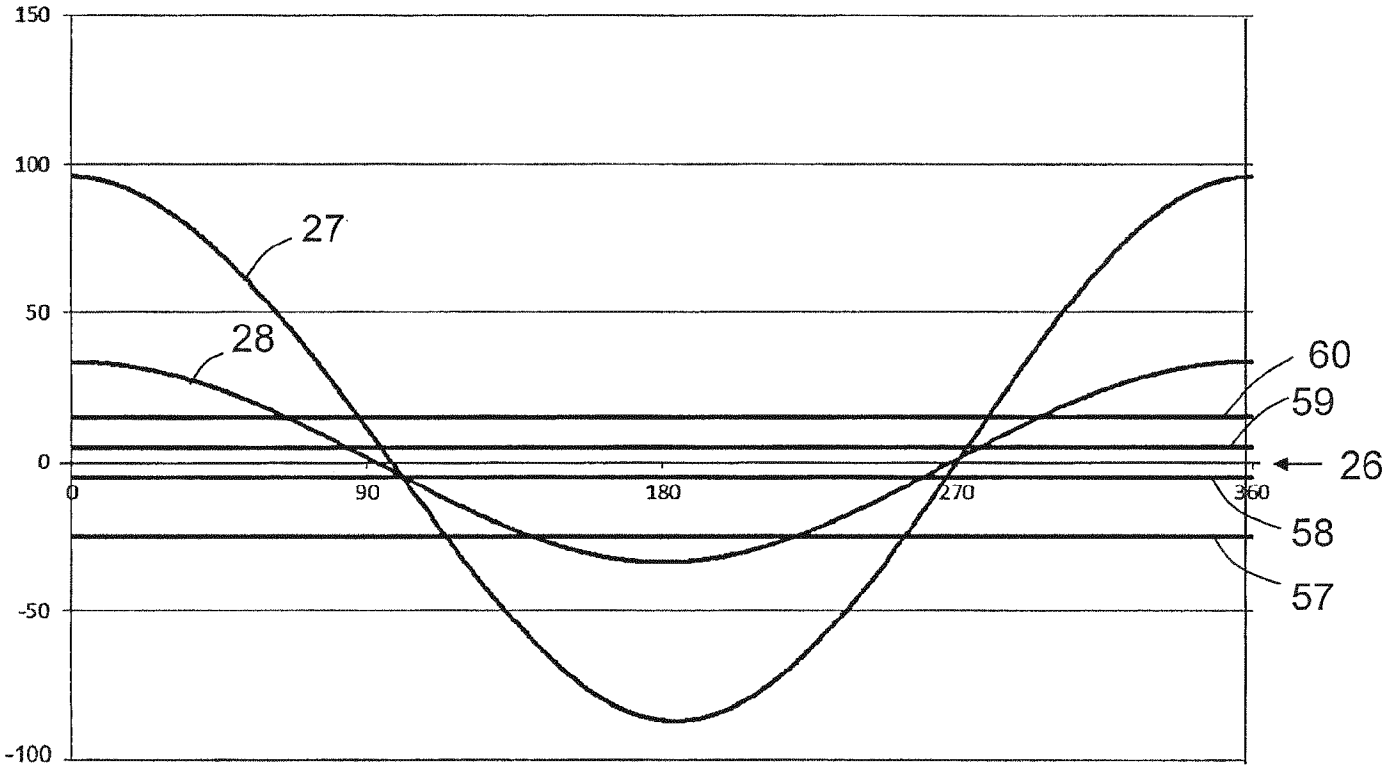
FIG. 7 shows two movement courses of a heald frame for two different strokes.
Figure 8:
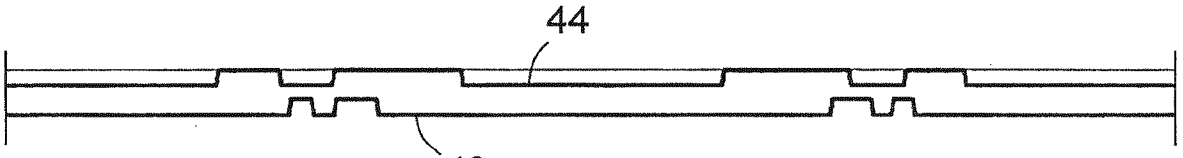
FIG. 8 shows two signal courses of a sensor device for the movement courses of FIG. 7.

FIG. 7 shows a movement course 27 of a heald frame 1 (see FIG. 1) with a maximal stroke and a movement course 28 of a heald frame 1 with a minimal stroke as well as corresponding signal courses 43, 44. The first target 21 is in front of the detector 23 at an orientation of the swivel lever 6 between the lines 57 and 58, whereas the second target 22 is in front of the detector 23 at an orientation of the swivel lever 6 between the lines 59 and 60. De central position 26 is located between the lines 58 and 59. As can be derived from FIG. 7, when changing the stroke, the state at which the swivel lever 6 and, thus, the heald frame 1 reaches a central position with respect to an angular position or orientation of a main shaft of the weaving machine is also changed. Therefore, after adjusting the stroke, a processing device 38 for a drive motor 31 driving the crank 3 (see FIG. 1) is adjusted in order to synchronize the movement of the heald frame 1 with the main shaft of the weaving machine. In an embodiment, when the swivel lever 6 is in the central position between the upper position and the lower position, an encoder counter value is captured for determining a reference angular position of the crank 3, thus a reference orientation of the crank 3. Further, a timing of driving the crank 3 as well as a speed of the drive motor 31 can be adjusted. For example, the drive motor 31 can be driven with a settable and/or variable speed during each weaving cycle.

In order to allow for a high flexibility, each heald frame 1 of a weaving machine is provided with an assigned drive mechanism 2, wherein all cranks 3 of the drive mechanisms are driven by an assigned drive motor 31.

FIGS. 9 to 12 show a drive system 30 comprising sixteen drive mechanisms in a front view, a top view and two perspective views, respectively. Hereafter the references 2, 3, 4, 5, 6, 8, 9, 10, 16, 17, 23, 31 are completed with ".1" to ".16" in relation to the sixteen different drive mechanisms. A drive motor 31.1 to 31.16 is assigned to each of the drive mechanisms 2.1 to 2.16. The drive motors 31.1 to 31.16 are arranged essentially in two rows, wherein eight drive motors are provided at each side of a housing 32 of the drive system 30, and pairs of two drive motors coaxially arranged are formed. In the embodiment shown, the drive motors 31.6, 31.4, and 31.2 are arranged slightly above the drive motors 31.14, 31.12, and 31.10 for allowing enough movement space for the coupling rods 5.1 to 5.16 of the respective drive mechanisms. Each crank 3.1 to 3.16 is driven by an individual drive motor 31.1 to 31.16. The crank axes 4.1 to 4.16 of the drive mechanisms 2.1 to 2.16 are arranged in parallel in their length direction, but offset from each other in the axial direction and/or perpendicular to the axial direction. The shed-forming device 29 can comprise a pair of almost identical drive mechanisms 2 having axially aligned crank axes 4.1 to 4.16.

Figure 9:
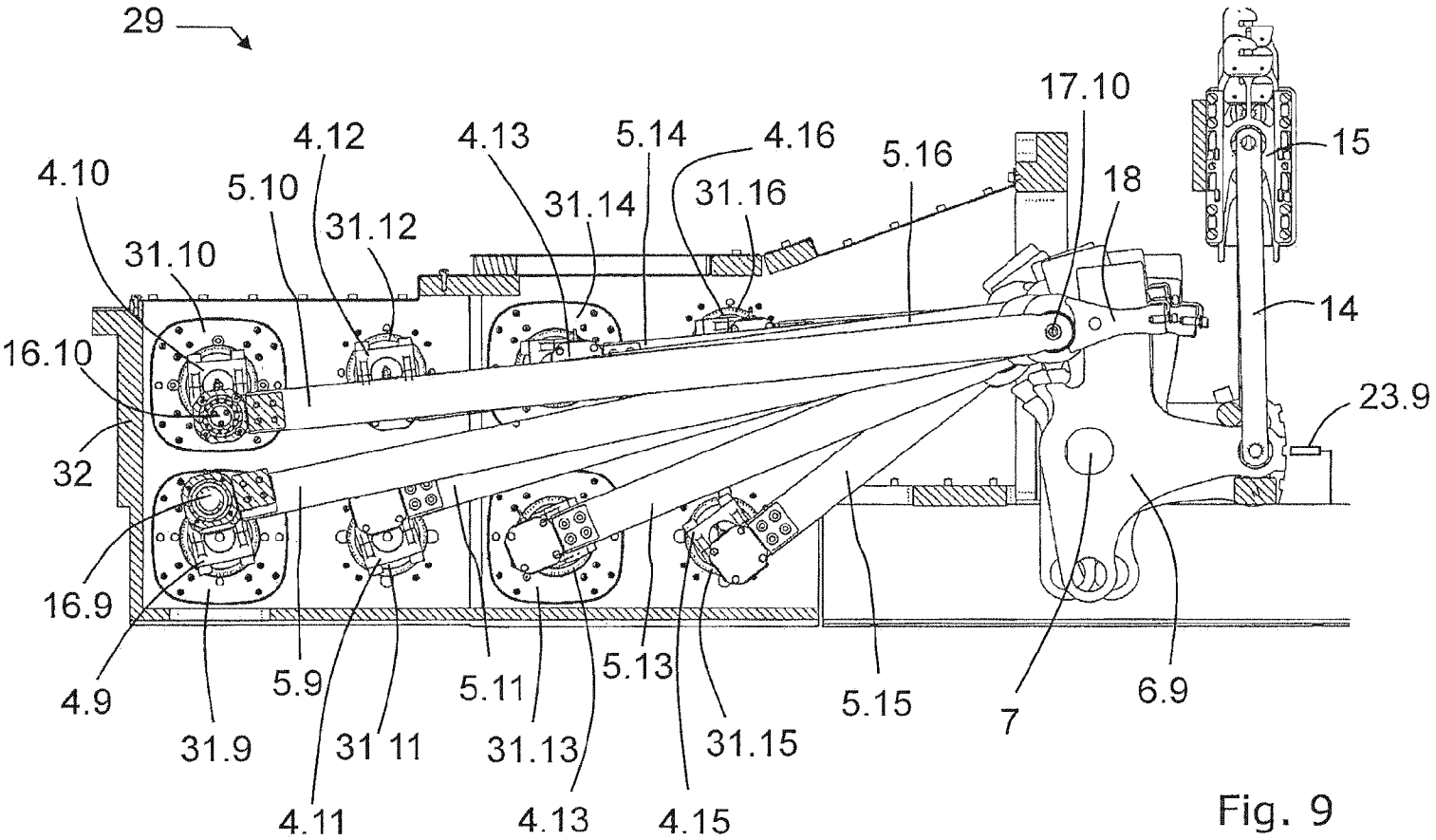
FIG. 9 shows a front view of a drive system comprising several drive mechanisms.
Figure 10:
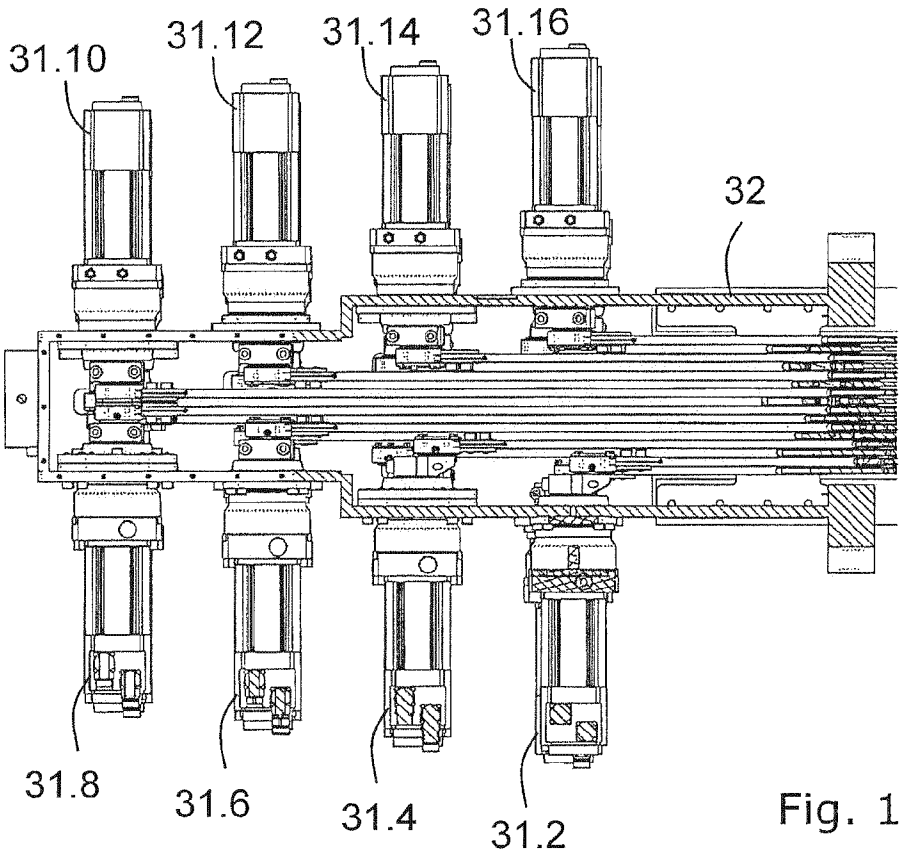
FIG. 10 shows a top view of the drive system of FIG. 9.
Figure 11:
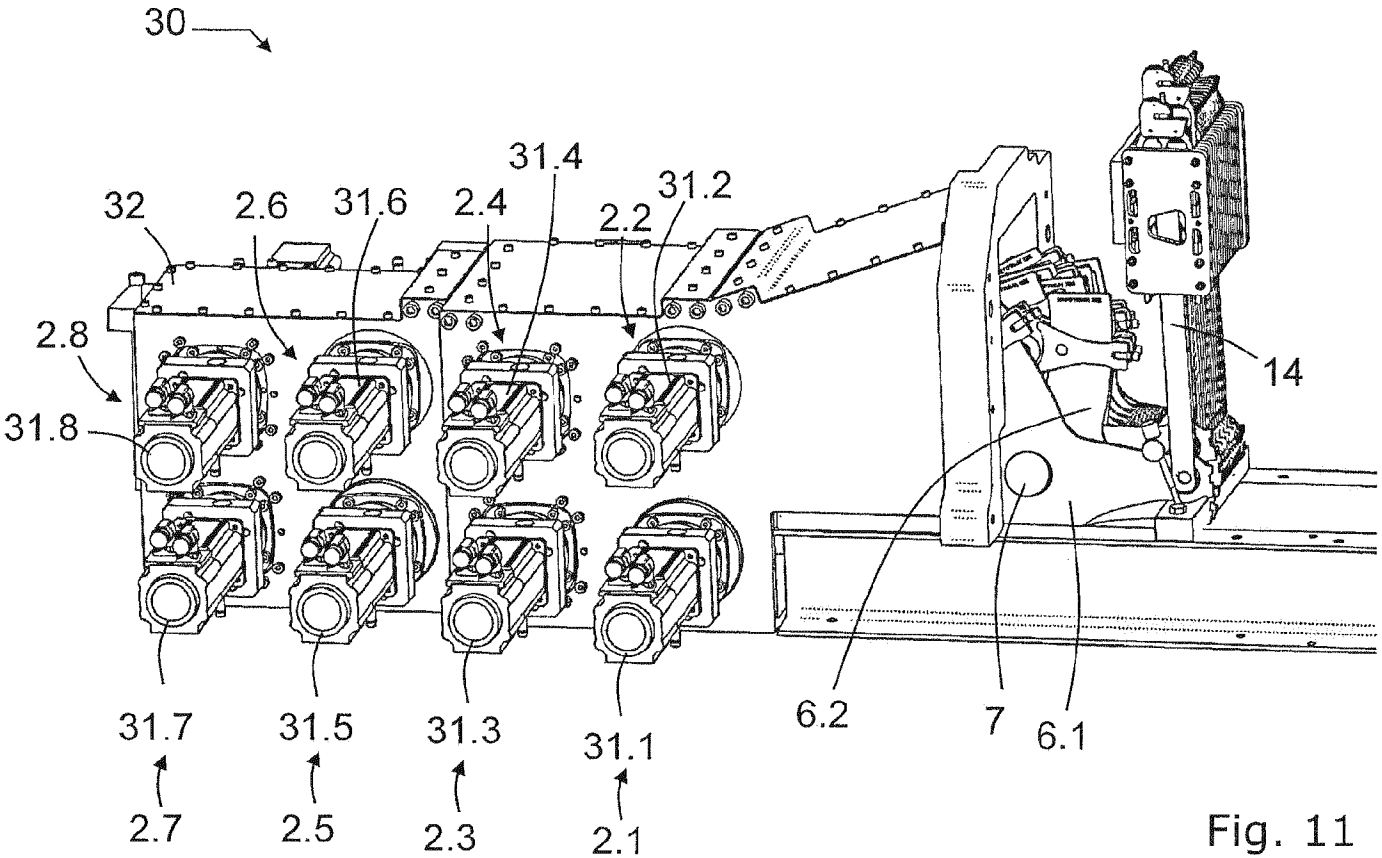
FIG. 11 shows the drive system of FIG. 9 in a perspective view.
Figure 12:
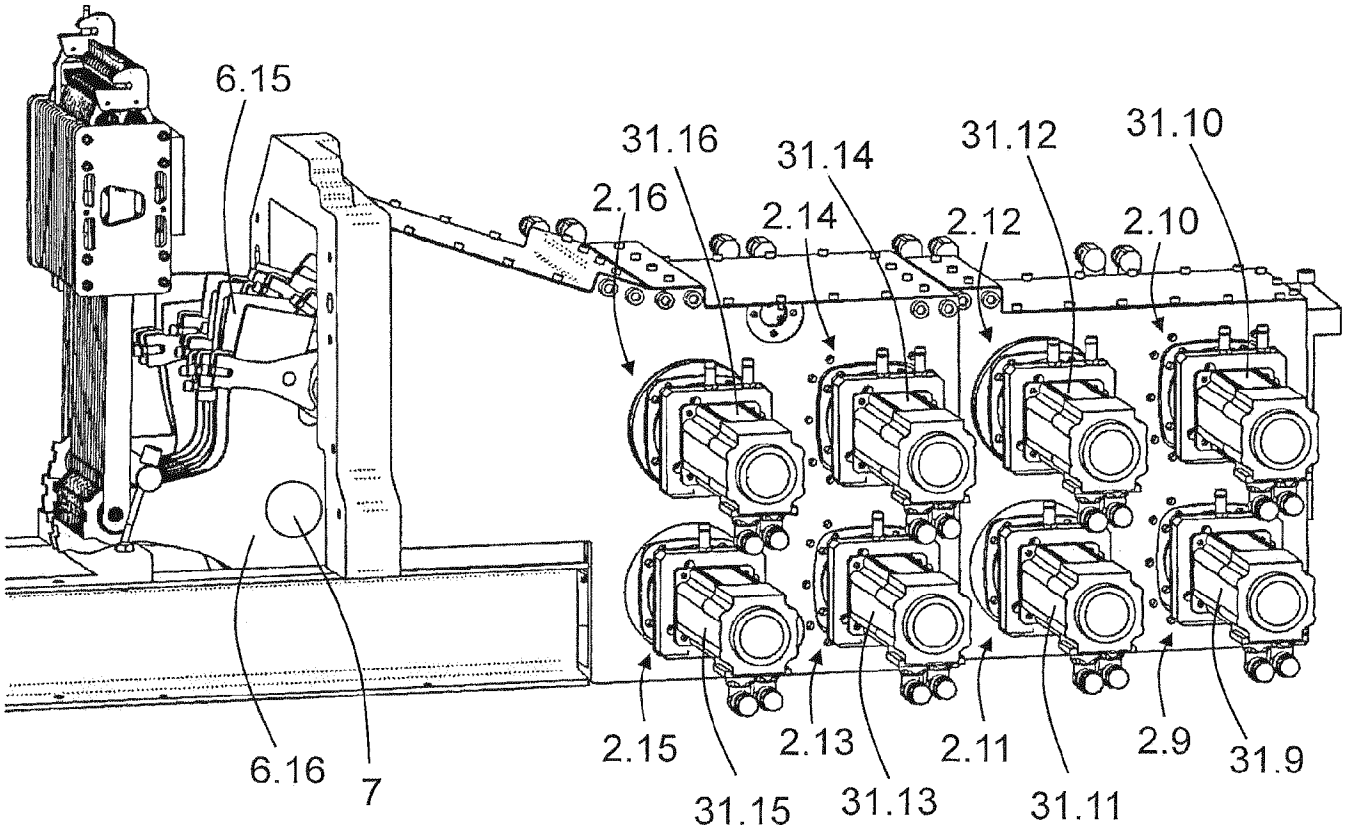
FIG. 12 shows the drive system of FIG. 9 in another perspective view.

Hereby, the signals of the sensor device 20, in particular the signals of the detectors 23.1 to 23.16 that respectively are assigned to a crank 4.1 to 4.16, are transmitted to a drive motor 31.1 to 31.16 drivingly coupled to the crank 3.1 to 3.16 of the drive mechanism 2.1 to 2.16, and the drive motor 31.1 to 31.16 is driven towards the measuring position to synchronize the drive mechanism 2.1 to 2.16 with the main shaft of the weaving machine. As the swivel lever 6.1 to 6.16 reaches the central position twice per revolution of the crank axis 4.1 to 4.16, there are two states per revolution of the crank axis 4.1 to 4.16 to synchronise the drive mechanism 2.1 to 2.16 with the main shaft of the weaving machine. In FIG. 9, only one detector 23.9 of the number of detectors 23.1 to 23.16 is shown. All detectors 23.1 to 23.16 are arranged in a row that extends parallel to the length direction of swivel axis 7.

As the geometry, in particular the length of the coupling rods 5.1 to 5.16 and hence, the distance of the first hinged joint 16.1 to 16.16 and the second hinged joint 17.1 to 17.16 differs for different drive mechanisms 2.1 to 2.16, the swivel levers 6.1 to 6.16 are individually designed for each drive mechanism 2.1 to 2.16. However, due to the arrangement in pairs for two drive mechanisms 2.1 to 2.16 of a common pair of drive mechanisms 2.1 to 2.16, elements of identical design can be used for some of the drive mechanisms 2.1 to 2.16. Hereby all swivel levers 6.1 to 6.16 are swivelable about a same swivel axis 7. As in a weaving machine the heald frames that are located farther away from the fell line need to move over a larger stroke in order to form a weaving shed, it is advantageous that the length of the cranks for the heald frames that are located farther away from the fell line increases. For example the cranks 4.1 to 4.4 have a same length, the cranks 4.5 to 4.8 are somewhat longer, the cranks 4.9 to 4.12 are still somewhat longer and the cranks 4.13 to 4.16 are the longest, as can be seen in FIG. 9. However, the length of the cranks 4.1 to 4.16 has no influence on the location of the imaginary circle 19 according to the invention.

Figure 13:
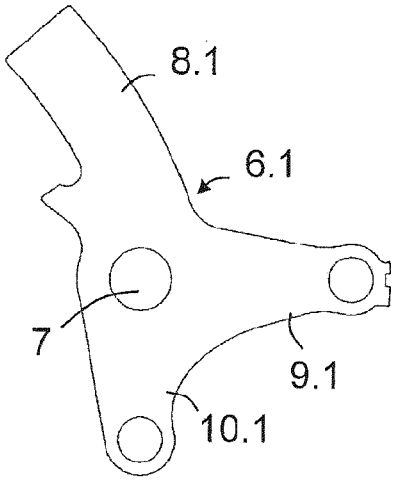
FIGS. 13 to 16 show several swivel levers of drive mechanisms according to the invention.
Figure 14:
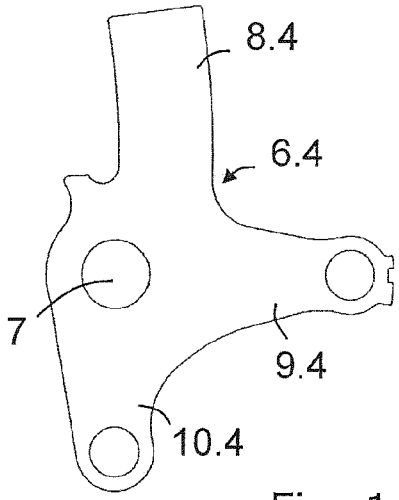
Figure 15:
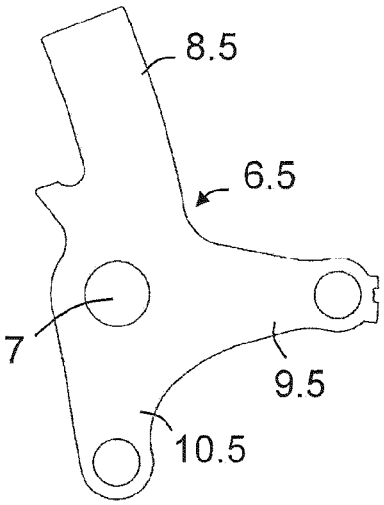
Figure 16:
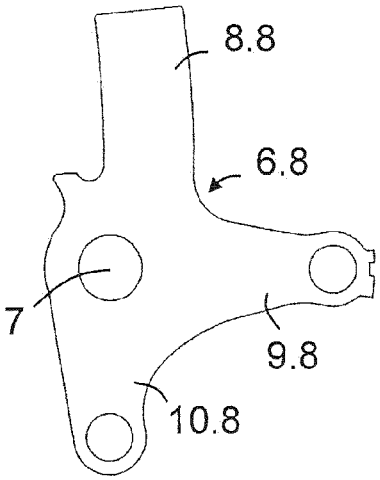

In FIGS. 13 to 16, by way of example, a number of a swivel levers is shown, more in particular in FIG. 13 the swivel lever 6.1, in FIG. 14 the swivel lever 6.4, in FIG. 15 the swivel lever 6.5, and in FIG. 16 the swivel lever 6.8. Hereby it is visible that all swivel levers differ in shape. It is clear that all swivel levers 6.1 to 6.16 have an individual shape that is adapted to meet the condition of the invention, more in particular this allows that in all intended locations of the second hinged joint 17, the second hinged joint 17 remains situated on an arc of an imaginary circle 19, as claimed in the claims.

In the context of the application the first arm 8 and the second arm 9 are defined for indicating a different function. Of course in an alternative embodiment the first arm 8 and the second arm 9 can be carried out in one piece.

The drive mechanism, the shed-forming device and the method according to the invention are not limited to the embodiments described by way of example and illustrated in the drawings. Alternatives and combinations of the described and illustrated embodiments that fall under the claims are also possible.

The invention claimed is:

1. A drive mechanism for driving a heald frame of a weaving machine, the drive mechanism comprising a crank rotating about a crank axis, a coupling rod, and a swivel lever having a first arm and a second arm, wherein the swivel lever is swivelable to-and-fro about a swivel axis between an upper position and a lower position, wherein the coupling rod is linked to the crank by a first hinged joint, which first hinged joint is eccentric to the crank axis, and the coupling rod is linked to the first arm of the swivel lever by a second hinged joint, and wherein a location of the second hinged joint is adjustable with respect to the first arm of the swivel lever, wherein in all intended locations of the second hinged joint with respect to the first arm of the swivel lever, the second hinged joint is situated on an arc of an imaginary circle when the swivel lever is in a central position between the upper position and the lower position, wherein the imaginary circle has a radius (R) that is equal to the distance (L) between the first hinged joint and the second hinged joint, and the imaginary circle has a center that coincides with the crank axis.

2. The drive mechanism according to claim 1, wherein the first arm of the swivel lever is curved and the location of the second hinged joint is adjustable along the first arm, wherein a curvature of the first arm is chosen so that upon adjusting of the location of the second hinged joint along the first arm, the second hinged joint remains situated on the arc of the imaginary circle when the swivel lever is in a central position between the upper position and the lower position.

3. The drive mechanism according to claim 2, wherein the coupling rod is mounted to the first arm by means of a mounting element, wherein the mounting element is slidably mounted to the first arm and fixable in a mounting position at the first arm, and wherein the coupling rod is mounted to the mounting element by the second hinged joint.

4. The drive mechanism according to claim 1, wherein the second arm extends horizontally when the swivel lever is arranged in the central position between the upper position and the lower position.

5. The drive mechanism according to claim 1, wherein a sensor device is provided for detecting a state at which the swivel lever reaches the central position between the upper position and the lower position, wherein preferably the sensor device comprises at least three members comprising both a target set with one or more targets and a detector set with one or more detectors, wherein one of the detector set and the target set is arranged on the swivel lever and the other one is arranged stationary on the weaving machine, wherein targets of the target set and/or detectors of the detector set have different properties for generating a first signal when approaching the central position from the upper position or when departing from the central position towards the upper position and for generating a second signal when approaching the central position from the lower position or when departing from the central position towards the lower position, wherein the second signal differs from the first signal.

6. A shed-forming device with a number of heald frames and an equal number of drive mechanisms according to claim 1, wherein each drive mechanism comprises a crank, a coupling rod and a swivel lever, and wherein one drive mechanism is assigned to each heald frame.

7. The shed-forming device according to claim 6, wherein each crank is driven by an individual drive motor.

8. The shed-forming device according to claim 6, wherein the crank axes of the drive mechanisms are arranged in parallel in their length direction, but offset from each other in the axial direction and/or perpendicular to the axial direction.

9. The shed-forming device according to claim 8, wherein the shed-forming device comprises at least one pair of drive mechanisms having axially aligned crank axes.

10. A method for adjusting a stroke of a heald frame of a weaving machine, wherein the heald frame is driven by a drive mechanism comprising a crank rotating about a crank axis, a coupling rod, and a swivel lever having a first arm and a second arm, wherein the swivel lever is swivelable to-and-fro about a swivel axis between an upper position and a lower position, and wherein the coupling rod is linked to the crank by a first hinged joint, which first hinged joint is eccentric to the crank axis, and the coupling rod is linked to the first arm of the swivel lever by a second hinged joint, the method comprising adjusting a location of the second hinged joint with respect to the first arm of the swivel lever, wherein the location of the second hinged joint is adjusted in such way that the second hinged joint remains situated on an arc of an imaginary circle when the swivel lever is in a central position between the upper position and the lower position, wherein the imaginary circle has a radius (R) that is equal to the distance (L) between the first hinged joint and the second hinged joint, and the imaginary circle has a center that coincides with the crank axis.

11. The method according to claim 10, wherein the first arm of the swivel lever is curved and the location of the second hinged joint is adjusted along the first arm, wherein a curvature of the first arm is chosen so that upon adjusting the location of the second hinged joint along the first arm the second hinged joint is moved along the arc of the imaginary circle.

12. The method according to claim 10, wherein during an adjustment of the location of the second hinged joint, the crank is held in position and the swivel lever is moved with respect to the crank, wherein preferably after adjusting the location of the second hinged joint the crank is driven to move the swivel lever into a measuring position, in particular into the central position between the upper position and the lower position, for a synchronization with a main shaft of the weaving machine.

13. The method according to claim 10, wherein a state is detected, when the swivel lever reaches the central position between the upper position and the lower position.

14. The method according to claim 13, wherein a first signal is generated by the sensor device when the swivel lever approaches the central position from the upper position or when the swivel lever departs from the central position towards the upper position and a second signal is generated by the sensor device when the swivel lever approaches the central position from the lower position or when the swivel lever departs from the central position towards the lower position, wherein the second signal differs from the first signal.

15. The method according to claim 13, wherein when the swivel lever is in the central position between the upper position and the lower position, a reference orientation of the crank is determined.

* * * * *